US010154701B2

(12) United States Patent
Lambert

(10) Patent No.: US 10,154,701 B2
(45) Date of Patent: Dec. 18, 2018

(54) GARMENT ACCESSORIES

(71) Applicant: Christopher Lambert, Marshall, VA (US)

(72) Inventor: Christopher Lambert, Marshall, VA (US)

( * ) Notice: Subject to any disclaimer, the term of this patent is extended or adjusted under 35 U.S.C. 154(b) by 0 days.

(21) Appl. No.: 15/719,182

(22) Filed: Sep. 28, 2017

(65) Prior Publication Data

US 2018/0027905 A1 Feb. 1, 2018

Related U.S. Application Data

(63) Continuation-in-part of application No. 15/057,904, filed on Mar. 1, 2016, which is a continuation-in-part (Continued)

(51) Int. Cl.

*A41D 25/00* (2006.01)
*A41D 25/10* (2006.01)

(Continued)

(52) U.S. Cl.

CPC ..... *A41D 25/003* (2013.01); *A41D 25/10* (2013.01); *A41D 27/08* (2013.01); *A44B 6/00* (2013.01); *A44C 25/008* (2013.01); *A41D 25/027* (2013.01)

(58) Field of Classification Search

CPC .. A41D 25/003; A41D 25/006; A41D 25/008; A41D 25/16; A41D 25/10; A41D 25/14; A41D 25/027; A41D 25/025; A41D 25/06; A41D 23/00; A41D 2023/006; A41D 25/00; A41D 25/01; A41D 25/02; A41D 25/022; A41D 25/08; A41D 27/08;

(Continued)

(56) References Cited

U.S. PATENT DOCUMENTS 153,758 A 8/1874 Dayton
265,459 A * 10/1882 Sundberg ..... A41D 25/022 24/104

(Continued)

FOREIGN PATENT DOCUMENTS

DE 102006043866 1/2008
EP 2633786 9/2013

(Continued)

OTHER PUBLICATIONS

International Search Report and Written Opinion dated Dec. 9, 2014 in related PCT Application No. PCT/US2014/053851 filed Sep. 3, 2014 (6 pages).

*Primary Examiner* — Amy Vanatta
(74) *Attorney, Agent, or Firm* — Dentons US LLP

(57) ABSTRACT

An accessory is provided. The accessory is for use with a garment, such as a necktie or others. For example, the necktie includes a knot and an elongated portion extending from the knot downwardly. The accessory includes a helical body. The body includes a first end portion and a second end portion. The first end portion includes a tab extending therefrom. The tab is operative to secure onto the knot via tucking behind the knot such that the body at least partially overlays the knot frontally and extends from the tab helically around the elongated portion at least once and the second end portion is visible below the knot frontally.

20 Claims, 16 Drawing Sheets

Related U.S. Application Data of application No. 14/295,955, filed on Jun. 4, 2014, now Pat. No. 9,282,776.

(60) Provisional application No. 61/872,978, filed on Sep. 3, 2013.

(51) Int. Cl.

| | |
|---|---|
| ***A41D 27/08*** | (2006.01) |
| ***A44B 6/00*** | (2006.01) |
| ***A44C 25/00*** | (2006.01) |
| *A41D 25/02* | (2006.01) |

(58) Field of Classification Search

CPC .... A41D 2200/10; A44B 6/00; A44C 25/008; A44C 1/00; A44C 15/003; A44C 25/00; A41F 3/00; A41F 3/02; A41F 9/00; A41F 9/002

USPC ..... 2/153; 24/66.2, 66.3, 66.9, 66.11, 58, 24/66.7, 66.12; D11/202, 203, 204, 205

See application file for complete search history.

(56) References Cited

U.S. PATENT DOCUMENTS 1,122,180 A * 12/1914 Weyburn et al. .... A41D 25/003 2/145
1,213,086 A 1/1917 Faugno et al.
1,253,457 A * 1/1918 Atkinson ..... A41D 25/025 2/153
1,366,864 A 1/1921 Edward et al.
1,737,632 A 12/1929 Alfred et al.
1,877,677 A 9/1932 Manaster et al.
1,909,650 A 5/1933 Yoseph et al.
1,923,577 A 8/1933 Manaster et al.
1,923,824 A 8/1933 Heitzman et al.
2,022,346 A 11/1935 Hickok et al.
2,024,085 A 12/1935 Baer et al.
2,050,433 A * 8/1936 Hill ..... A41D 25/022 24/66.9
2,146,047 A 2/1939 Bangs et al.
2,157,623 A * 5/1939 Nugent ..... A41D 25/14 2/153
D126,983 S 5/1941 Lisi
2,384,694 A 9/1945 Henery et al.
2,408,455 A 10/1946 Taborski et al.
2,456,848 A 12/1948 Martin et al.
2,465,947 A 3/1949 Ve et al.
2,534,457 A 12/1950 Lang et al.
2,561,003 A * 7/1951 Wilson ..... A41D 25/10 24/546
2,636,179 A * 4/1953 Churchill ..... A41D 25/02 2/153
2,754,518 A 7/1956 Vary et al.
2,787,002 A 4/1957 De la Piedra
2,864,089 A 12/1958 Woluns et al.
2,972,749 A * 2/1961 Gruber ..... A41D 25/14 2/153
3,173,148 A 3/1965 Horii
3,183,612 A * 5/1965 Romaine ..... A41D 23/00 2/150
3,381,865 A * 5/1968 Pehr ..... A47G 21/165 2/145
3,827,108 A 8/1974 Jewett
3,833,937 A * 9/1974 Taylor ..... A41D 25/006 2/46
4,038,724 A * 8/1977 Parizek ..... A41D 25/022 2/207
4,410,772 A 10/1983 Sato
4,530,221 A * 7/1985 Weinberg ..... A44C 5/209 24/116 A
4,686,716 A 8/1987 Burns
4,977,624 A 12/1990 Safford
4,997,222 A 3/1991 Reed
5,010,593 A 4/1991 Stevens, Jr.
5,035,002 A 7/1991 Knight, Jr.
D319,035 S 8/1991 Kruse
D335,473 S 5/1993 Sprick
5,526,550 A 6/1996 Huang
5,575,161 A 11/1996 Hinchey
5,797,144 A * 8/1998 Ciccone ..... A44B 6/00 2/144
5,799,842 A 9/1998 Rumsey
5,864,882 A 2/1999 Kowalyk
D442,886 S 5/2001 Carrell, Jr.
6,490,763 B2 12/2002 Tamura
6,904,613 B2 6/2005 Dotterer
D572,626 S 7/2008 Merriam-Smith
8,230,557 B2 * 7/2012 McNeil ..... A44B 6/00 2/144
8,914,948 B2 * 12/2014 Rissmeyer ..... A41D 23/00 2/207
D724,325 S 3/2015 Klein et al.
2005/0198785 A1 9/2005 Sens-Grosholz et al.
2007/0298683 A1 12/2007 Shaffstall
2011/0088143 A1 4/2011 Lee
2011/0302692 A1 12/2011 Hanspiker
2014/0349256 A1 * 11/2014 Connor ..... G09B 19/0092 434/127

FOREIGN PATENT DOCUMENTS

| | | |
|---|---|---|
| GB | 495936 | 11/1938 |
| JP | H0881810 | 3/1996 |
| WO | WO2006036660 | 4/2006 |
| WO | WO2011156894 | 12/2011 |

* cited by examiner

FIG. 8A FRONT

FIG. 8B REAR

FIG. 8C SIDE

FIG. 9A FRONT

FIG. 9B REAR

FIG. 9C SIDE

GARMENT ACCESSORIES

CROSS-REFERENCE TO RELATED APPLICATIONS

This application is a Continuation-in-Part of U.S. application Ser. No. 15/057,904, filed Mar. 1, 2016; which is a Continuation-in-Part of U.S. application Ser. No. 14/295,955, filed Jun. 4, 2014, now U.S. Pat. No. 9,282,776 issued Mar. 15, 2016; which claims a benefit of U.S. Application 61/872,978, filed Sep. 3, 2013; each of which is fully incorporated by reference herein for all purposes.

TECHNICAL FIELD

Generally, the present disclosure relates to clothing accessories. More particularly, the present disclosure relates to necktie accessories.

BACKGROUND

In the present disclosure, where a document, an act and/or an item of knowledge is referred to and/or discussed, then such reference and/or discussion is not an admission that the document, the act and/or the item of knowledge and/or any combination thereof was at the priority date, publicly available, known to the public, part of common general knowledge and/or otherwise constitutes prior art under the applicable statutory provisions; and/or is known to be relevant to an attempt to solve any problem with which the present disclosure may be concerned with.

A necktie is usually an elongated piece of cloth. When the necktie is conventionally tied, then the necktie contains a loop portion, a knot extending from the loop portion, and a pair of elongated overlapping portions extending from the knot. When the conventionally tied necktie is conventionally worn with a shirt having a collar with a pair of ends, then the loop portion rests underneath the collar, the knot rests between the pair of ends, and the elongated portions extending from the knot downward.

For proper aesthetic appearance, a person wearing the shirt and the necktie often desires that the knot remain substantially centered between the pair of ends. However, such positioning is difficult to maintain since the person is usually moving around. Some necktie accessories have been devised to reduce movement of the knot between the pair of ends. However, most of such accessories are unaesthetic and/or inoperative without markedly impacting the necktie's structural integrity.

While certain aspects of conventional technologies have been discussed to facilitate the present disclosure, no technical aspects are disclaimed. The claims may encompass at least one of the conventional technical aspects discussed herein.

BRIEF SUMMARY

The present disclosure may at least partially address at least one of the above. However, the present disclosure may at least partially prove useful in at least partially addressing other problems and/or deficiencies in a number of technical areas. Therefore, the claims should not be construed as necessarily limited to addressing any of the above.

According to an example embodiment of the present disclosure an accessory is provided. The accessory is for use with a necktie. The necktie includes a knot and an elongated portion extending from the knot downwardly. The accessory includes a helical body. The body includes a first end portion and a second end portion. The first end portion includes a tab extending therefrom. The tab is operative to secure onto the knot via tucking behind the knot such that the body at least partially overlays the knot frontally and extends from the tab helically around the elongated portion at least once and the second end portion is visible below the knot frontally.

According to another example embodiment of the present disclosure a method is provided. The method includes manufacturing an accessory for use with a necktie. The necktie includes a knot and an elongated portion extending from the knot downwardly. The accessory includes a helical body. The body includes a first end portion and a second end portion. The first end portion includes a tab extending therefrom. The tab is operative to secure onto the knot via tucking behind the knot such that the body at least partially overlays the knot frontally and extends from the tab helically around the elongated portion at least once and the second end portion is visible below the knot frontally. The body and the tab are unitary.

According to yet another example embodiment of the present disclosure a method is provided. The method includes wearing an accessory with a necktie. The necktie includes a knot and an elongated portion extending from the knot downwardly. The accessory includes a helical body. The body includes a first end portion and a second end portion. The first end portion includes a tab extending therefrom. The tab is secured onto the knot via tucking behind the knot such that the body at least partially overlays the knot frontally and extends from the tab helically around the elongated portion at least once and the second end portion is visible below the knot frontally. The body and the tab are unitary.

The present disclosure may be embodied in the form illustrated in the accompanying drawings. However, attention is called to the fact that the drawings are illustrative. Variations are contemplated as being part of the disclosure, limited only by the scope of the claims.

BRIEF DESCRIPTION OF DRAWINGS

The accompanying drawings illustrate example embodiments of the present disclosure. Such drawings are not to be construed as necessarily limiting the disclosure. Like numbers and/or similar numbering scheme can refer to like and/or similar elements throughout.

DETAILED DESCRIPTION OF PREFERRED EMBODIMENTS

Figure 1:
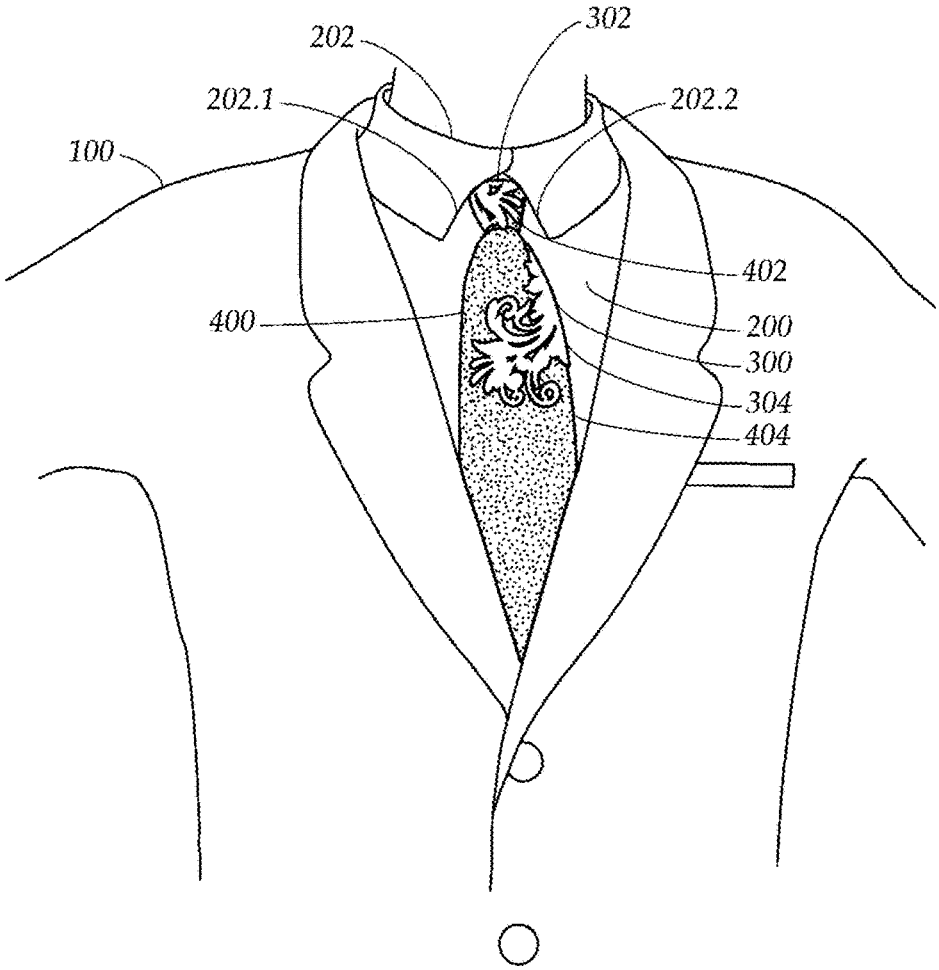
FIG. 1 shows an example embodiment of a necktie accessory worn with a shirt and a tie according to the present disclosure.

The present disclosure is now described more fully with reference to the accompanying drawings, in which example embodiments of the present disclosure are shown. The present disclosure may, however, be embodied in many different forms and should not be construed as necessarily being limited to the example embodiments disclosed herein. Rather, these example embodiments are provided so that the present disclosure is thorough and complete, and fully conveys the concepts of the present disclosure to those skilled in the relevant art. Also, features described with respect to certain example embodiments may be combined in and/or with various other example embodiments. Different aspects and/or elements of example embodiments, as disclosed herein, may be combined in a similar manner.

The terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements may be present, including indirect and/or direct variants. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the present disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof. Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (30) printing, laser cutting, computer numerical control (CNC) routing, milling, pressing, stamping, vacuum forming, hydroforming, injection molding, lithography, and so forth.

Any and/or all elements, as disclosed herein, can include, whether partially and/or fully, a solid, including a metal, a mineral, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, reflection, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

As used herein, the term "about" and/or "substantially" refers to an up to and including a +/−10% variation from the nominal value/term. Such variation is always included in any given value/term provided herein, whether or not such variation is specifically referred thereto.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

If any disclosures are incorporated herein by reference and such incorporated disclosures conflict in part and/or in whole with the present disclosure, then to the extent of conflict, and/or broader disclosure, and/or broader definition of terms, the present disclosure controls. If such incorporated disclosures conflict in part and/or in whole with one another, then to the extent of conflict, the later-dated disclosure controls.

FIG. 1 shows an example embodiment of a necktie accessory worn with a shirt and a tie according to the present disclosure. A person, whether a male and/or a female, a toy, a mascot, and/or a mannequin is wearing a jacket 100, a shirt 200, a necktie accessory 300, and a necktie 400. Jacket 100, shirt 200, and/or necktie 400 can be used for decorative purposes, festive purposes, uniform purposes, membership symbol purposes, business purposes, theatric purposes, and so forth.

Jacket 100 can be of any type, whether for formal and/or non-formal occasion, such as a suit jacket, a sports jacket, a tuxedo jacket, a tailcoat, and so forth. Jacket 100 can be of any size, color, visual design and/or include any stitching and/or material, such as wool, cotton, silk, and so forth. Jacket 100 can be buttoned, button free, zippered, and so forth. Jacket 100 can include a wearable computing device. At least one corner of jacket 100 can be acute or rounded. In other example embodiment, jacket 100 is lacking. In another example embodiment, a sweater replaces jacket 100.

Shirt 200 includes a collar 202 having a first collar end 202.1 and a second collar end 202.2. Collar 202 can be of any type, such as a button down collar, a straight collar, a spread collar, a hidden button down collar, a windsor collar, a tab collar, and so forth. Collar end 202.1 and/or collar end 202.2 can be of any type, whether identical to or different from each other in any way, such as size, shape, material, and so forth.

Shirt 200 can be of any type, whether for formal and/or non-formal occasion, size, color, visual design and/or include any stitching and/or material, such as wool, cotton, silk, and so forth. Shirt 200 can include a wearable computing device. Note that shirt 200 can be of any type, such as a collared shirt, a button down dress shirt, a wing-tip shirt, a ruffled shirt, a collarless shirt, a turtleneck shirt, a T-shirt, and so forth. Shirt 200 can be long sleeve based and/or short sleeve based. Shirt 200 can be buttoned, button free, zippered, and so forth. Shirt 200 can be tucked into a pair of shorts or pants and/or remain untucked. At least one corner of shirt 200 can be acute and/or rounded. In other example embodiments, shirt 200 is lacking.

Necktie 400 includes a knot 402 and an elongated portion 404 extending downward away from knot 402. At least one corner of necktie 400 can be acute or rounded. Necktie 400 can be of any size, shape, color, visual design and/or include any stitching and/or material, such as wool, cotton, silk, and so forth. Necktie 400 can include a wearable computing device. Necktie 400 can include a necktie accessory thereon. Necktie 400 can be any type, such as a tied necktie, a zip-up necktie, an elastic loop tie, a clip-on necktie, a thin necktie, a thick necktie, a magnetic tie, and so forth. Note that knot 402 can visibly appear as a tied knot, but not be an actual tied knot.

Knot 402 can be of any shape, such as a triangle of any type, an ellipse of any type, a parallelogram of any type, a quadrilateral of any type, and so forth. Knot 402 can be of any type, such as a four-in-hand knot, a windsor knot, a half-windsor knot, and so forth.

Portion 404 can be of any shape, such as a triangle of any type, an ellipse of any type, a parallelogram of any type, a quadrilateral of any type, and so forth. When knot 402 is tied, then portion 404 can overlap another necktie portion if necktie 400 includes such portion, which can be identical to and/or different from portion 404 in any manner, dimension, shape, material, color, design, and so forth. However, in an another example embodiment, such another portion can be lacking from necktie 400 and only portion 404 extends vertically away from knot 402.

Accessory 300 is fully unitary, but in other embodiments accessory 300 is an assembly of components. Accessory 300 includes a knot portion 302 and a helical portion 304 helically extending from knot portion 302. Portion 302 is substantially overlying knot 402 such that most of knot 402 is frontally invisible to others. Portion 304 is partially overlying portion 404. Portion 302 and portion 304 are ornamentally decorated. However, in other example embodiments, such decoration can be alternately lacking and/or present, whether in an identical and/or different manner. Further, such decoration can be of any type, such as nature, animals, fish, birds, logos, sports teams, cartoon characters, religious symbols, celebrities, modern art, and so forth.

Accessory 300 can be at least partially perforated. However, accessory 300 can also be structured to lack any perforations therethrough. Accessory 300 includes a plurality of acute corners, although such corners can also be rounded. Note that accessory 300 can include an acute corner and a rounded corner. Accessory 300 can be used as jewelry and/or can be manufactured and/or include a precious metal and/or a stone, such as silver, gold, platinum, a diamond, a sapphire, a ruby, and so forth. Accessory 300 can be ruggedly or smoothly surfaced, whether internally and/or externally.

Figure 2A:
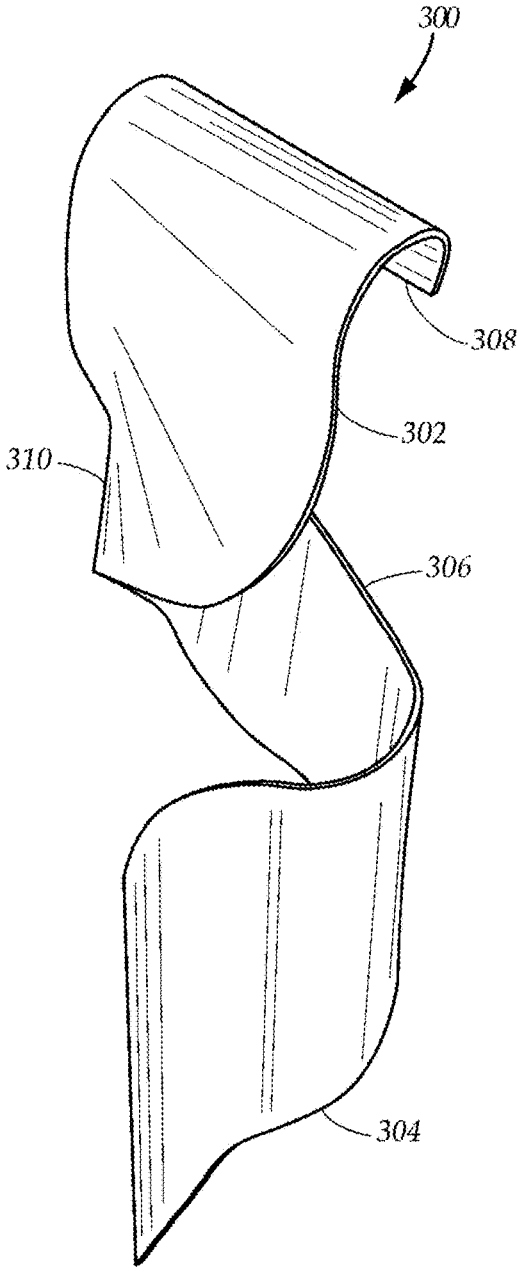
FIG. 2A shows a perspective view of an example embodiment of a necktie accessory according to the present disclosure.

FIG. 2A shows a perspective view of an example embodiment of a necktie accessory according to the present disclosure. Some elements of this figure are described above. Thus, same and/or similar reference characters identify same and/or like components described above and any repetitive detailed description thereof will hereinafter be omitted or simplified in order to avoid complication.

Portion 302 includes an L-tab 308, which is operative for tucking behind knot 402 and at least partially overlie knot 402. L-tab 308 can include a protrusion extending therefrom such that L-tab 308 turns into a J-shape, which can also tuck under knot 402. Note that L-tab 308 can include a corner, which can be rounded, acute, and so forth. L-tab 308 can be ruggedly or smoothly surfaced, whether internally and/or externally.

Portion 304 includes a body 306 helically extending from L-tab 308 such that body 306 is operative for helically extending around portion 404 at least once below knot 402. Body 306 can be at least partially frontally visible to others during such extending. Note that such helical extending can be in any direction, whether clockwise or counter-clockwise.

Further, accessory 300 can include another body, whether identically or differently shaped, sized, structured, or constituted, interweaving with body 306 from L-tab 308. Portion 304 can be ruggedly or smoothly surfaced, whether internally and/or externally.

Body 306 has an end distal to L-tab 308. When body 306 helically extends around portion 404 at least once below knot 402, then the end is below knot 402 and can be frontally visible to others, but in other embodiments is invisible frontally to others.

Body 306 includes a side tab 310 positioned on body 306 between L-tab 308 and the end. Tab 310 can be L-shaped or J-shaped. When body 306 helically extends around portion 404 at least once below knot 402, then tab 310 abuts a peripheral edge of portion 404. Note that although tab 310 is shown on a right side of knot 402 when accessory 300 is worn, in other example embodiments, tab 310 can also be structured for positioning on a left side of knot 402 when accessory 300 is worn.

Figure 2B:
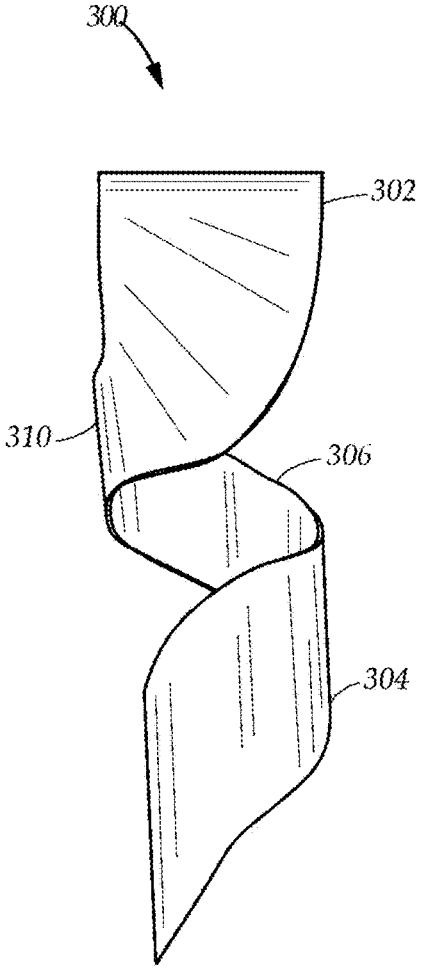
FIG. 2B shows a frontal view of an example embodiment of a necktie accessory according to the present disclosure.

FIG. 2B shows a front view of an example embodiment of a necktie accessory according to the present disclosure. Some elements of this figure are described above. Thus, same and/or similar reference characters identify same and/or like components described above and any repetitive detailed description thereof will hereinafter be omitted or simplified in order to avoid complication.

Note that the end of body 306 is below tab 308 and tab 310. When body 306 helically extends around portion 404 at least once below knot 402, then the end is below knot 402, tab 308 and tab 310. Although the end is not aligned vertically with tab 308 and/or tab 310, in other example embodiments, the end can be aligned vertically with tab 308 and/or tab 310.

Also, note how knot 402 would be substantially covered by portion 302, while L-tab 308 tucks behind knot 402. Portion 404 would be contained via tab 310 and body 304 extending helically around portion 404 such that body 304 helically extends around portion 404.

Figure 3:
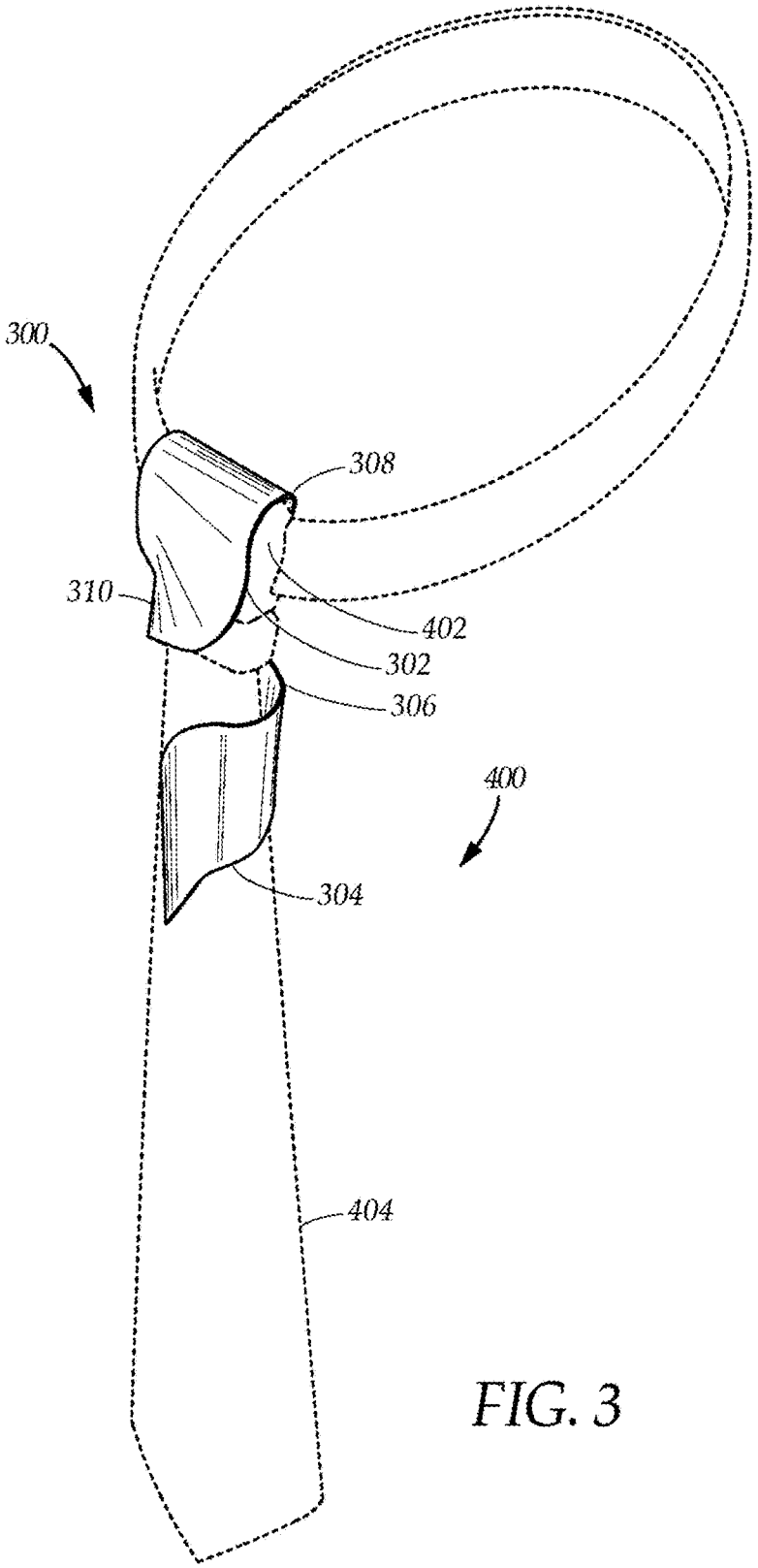
FIG. 3 shows a perspective view of an example embodiment of a necktie accessory accessorizing a necktie according to the present disclosure.

FIG. 3 shows a perspective view of an example embodiment of a necktie accessory accessorizing a necktie according to the present disclosure. Some elements of this figure are described above. Thus, same and/or similar reference characters identify same and/or like components described above and any repetitive detailed description thereof will hereinafter be omitted or simplified in order to avoid complication.

Note how L-tab 308 tucks behind knot 402 such that knot 402 is substantially frontally invisible to others because of portion 302. Also, note how portion 304 helically extends around portion 404 via body 306. Further, note how tab 310 and body 306 contain portion 404 therebetween.

As shown, tab 310 is on the right side of knot 402 when accessory 300 is worn. However, in another example embodiment, accessory 300 can be worn in a reverse manner where tab 310 is on the left side of knot 402 and L-tab 308 is frontally visible to others along with body 306, while the end is substantially frontally invisible to others.

Figure 4:
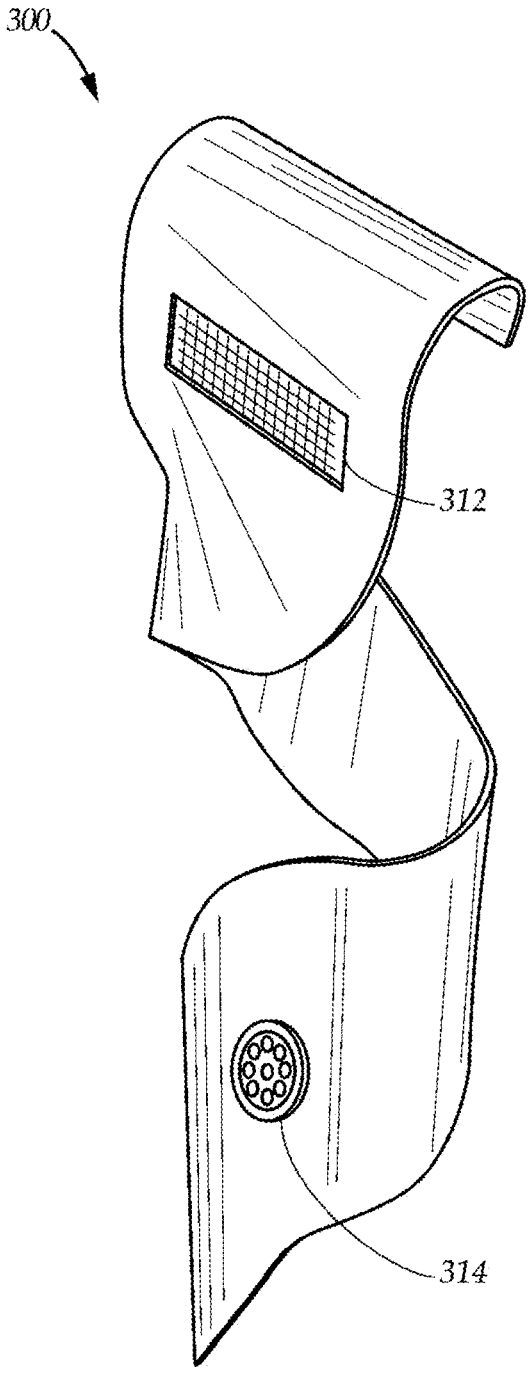
FIG. 4 shows a perspective view of an example embodiment of a necktie accessory having a solar cell and a microphone according to the present disclosure.

FIG. 4 shows a perspective view of an example embodiment of a necktie accessory having a solar cell and a microphone according to the present disclosure. Some elements of this figure are described above. Thus, same and/or similar reference characters identify same and/or like components described above and any repetitive detailed description thereof will hereinafter be omitted or simplified in order to avoid complication.

Accessory 300 includes a solar cell 312, a microphone 314, and circuitry, such as a processor, a flash memory, a wired data port, and an antenna, operative for enabling a wearer of accessory 300 to use microphone 314 as a sound input means for any purpose, such as personal communication, ambient communication, and so forth. Such circuitry and microphone 314 are powered via energy received from cell 312.

Cell 312 and/or microphone 314 can be ornamentally decorated or non-decorative. Cell 312 and/or microphone 314 can be camouflaged to blend in with accessory 300 to reduce conspicuous visual discernment and/or cell 312 and/or microphone 312 can be readily visible and not camouflaged. The circuitry can internally contained within accessory 300 or the circuitry can be coupled to accessory 300 externally.

Cell 312, such as a photovoltaic cell, can be positioned anywhere on body 306 such that cell 312 receives solar radiation, such as when accessory 300 is outside, and/or light radiation, such as via a bulb, and so forth. Accessory 300 can contain a battery for storing energy received from cell 312. The battery can be internally contained within accessory 300 or the battery can be coupled to accessory 300 externally. For example, microphone 314 can comprise the battery. The battery can be removable or non-removable. The circuitry can be powered via the battery. Microphone 314 can be powered via the battery. Microphone 314 can be positioned anywhere on body 306 such that microphone 314 can receive sounds, whether from a user wearing accessory 300 or from others nearby, such as for spying purposes.

In other example embodiments, accessory 300 can also include a speaker powered via the battery. For example, microphone 314 can comprise the speaker. Resultantly, accessory 300 can be configured to function as a headset, which communicates, whether wired or wirelessly, with a mobile phone, a laptop, a tablet, a desktop, another headset, a computer peripheral, a computer, an earpiece, a watch, a health monitoring device, and so forth, whether local to or remote from accessory 300. For example, via the antenna, the wireless communication can be via at least a short-range wireless communication protocol, such as infrared, Bluetooth®, and so forth.

Although cell 312 and microphone 314 are shown as distinct units, in other example embodiments, at least cell 312 and microphone 314 can be a single unit, which can include at least one of the circuitry, the battery, the speaker, and so forth. In another example embodiment, accessory 300 can include a display, which can fully at least externally span accessory 300 to provide a visual output for decorative purposes, which can alternate based on user input. Note that such display can also less than fully span accessory 300. Such display is powered via cell 312 and can be operative via the circuitry or via another device communicating with the display.

Further, in another example embodiment, accessory 300 can include a camera operative to capture at least one of a photo and a video. For example, microphone 314 can comprise the camera. The camera is powered via the battery. The photo and/or the video is stored in the flash memory. The photo and/or the video can be communicated via the antenna to a mobile phone, a laptop, a tablet, a desktop, another headset, a computer peripheral, a computer, an earpiece, a watch, a health monitoring device, and so forth, whether local to or remote from accessory 300. Note that in such example embodiments, accessory 300 can be used as a recording device operative to record at least one of a picture, a video and an audio.

Figure 5A:
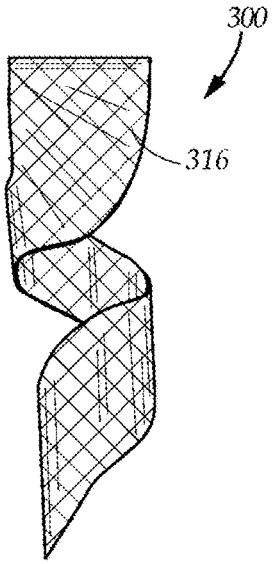
FIG. 5A shows a frontal view of an example embodiment of a necktie accessory having a first ornamental design according to the present disclosure.

FIG. 5A shows a frontal view of an example embodiment of a necktie accessory having a first ornamental design according to the present disclosure. Some elements of this figure are described above. Thus, same and/or similar reference characters identify same and/or like components described above and any repetitive detailed description thereof will hereinafter be omitted or simplified in order to avoid complication.

Accessory 300 includes a checkered design 316, which at least partially covers accessory 300 on an external surface and an internal surface. Note that such coverage can vary in any manner or be combined with another ornamental design.

Figure 5B:
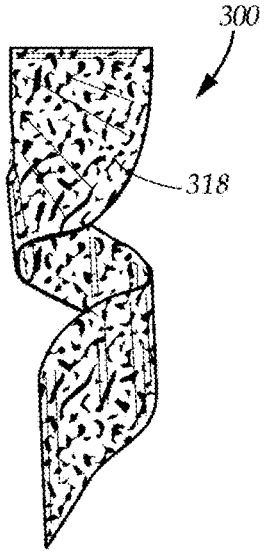
FIG. 5B shows a frontal view of an example embodiment of a necktie accessory having a second ornamental design according to the present disclosure.

FIG. 5B shows a frontal view of an example embodiment of a necktie accessory having a second ornamental design according to the present disclosure. Some elements of this figure are described above. Thus, same and/or similar reference characters identify same and/or like components described above and any repetitive detailed description thereof will hereinafter be omitted or simplified in order to avoid complication.

Accessory 300 includes a paisley design 318, which at least partially covers accessory 300 on an external surface and an internal surface. Note that such coverage can vary in any manner or be combined with another ornamental design, such as design 316.

Figure 5C:
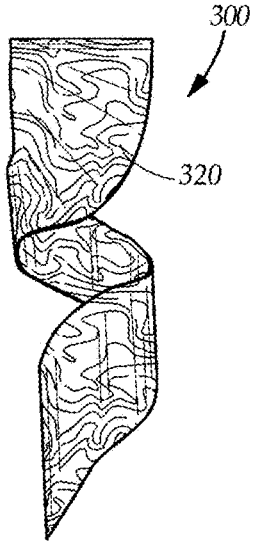
FIG. 5C shows a frontal view of an example embodiment of a necktie accessory having a third ornamental design according to the present disclosure.

FIG. 5C shows a frontal view of an example embodiment of a necktie accessory having a third ornamental design according to the present disclosure. Some elements of this figure are described above. Thus, same and/or similar reference characters identify same and/or like components described above and any repetitive detailed description thereof will hereinafter be omitted or simplified in order to avoid complication.

Accessory 300 includes a curved lines design 320, which at least partially covers accessory 300 on an external surface and an internal surface. Note that such coverage can vary in any manner or be combined with another ornamental design, such as design 316 and/or design 318. Further, note that such designs are examples only and other types of designs are included. For example, any type of design can be used, such as nature, animals, fish, birds, sports teams, cartoon characters, religious symbols, celebrities, modern art, and so forth.

Figure 6:
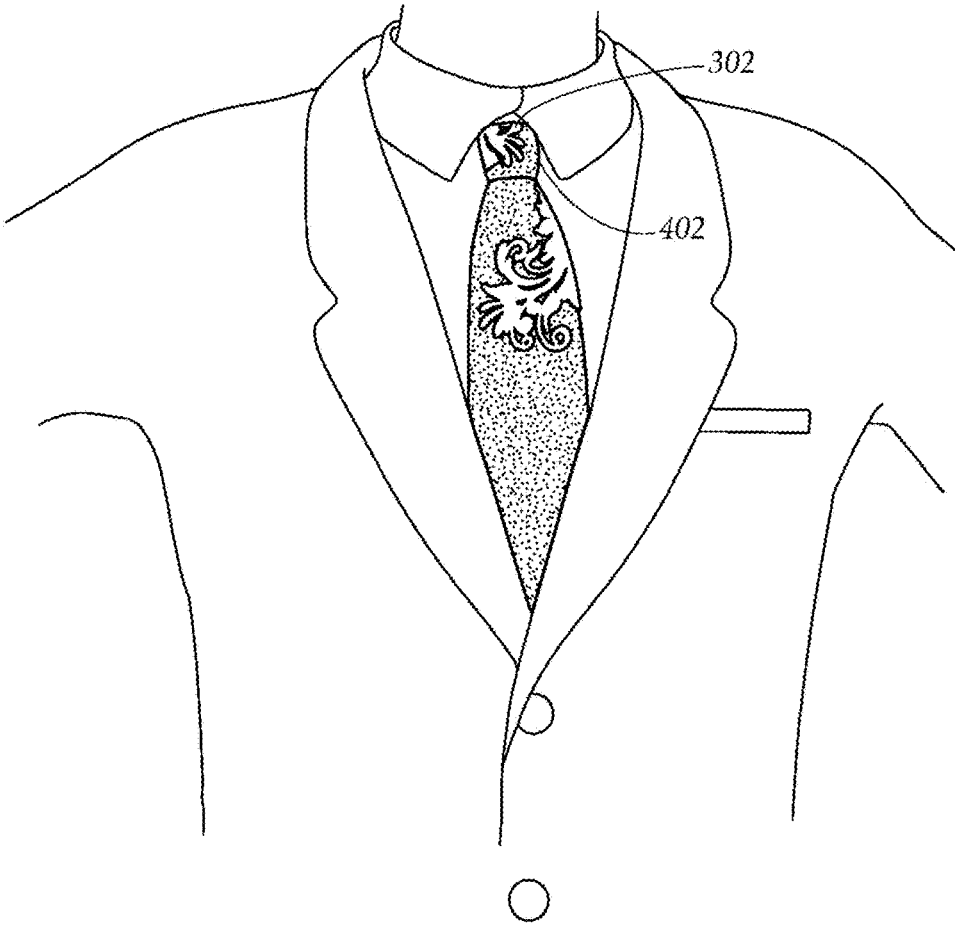
FIG. 6 shows an example embodiment of a necktie accessory worn with a shirt and a tie according to the present disclosure.

FIG. 6 shows an example embodiment of a necktie accessory worn with a shirt and a tie according to the present disclosure. Some elements of this figure are described above. Thus, same and/or similar reference characters identify same and/or like components described above and any repetitive detailed description thereof will hereinafter be omitted or simplified in order to avoid complication. Note how portion 302 partially overlays knot 402 such that most of knot 402 is frontally visible to others.

Figure 7:
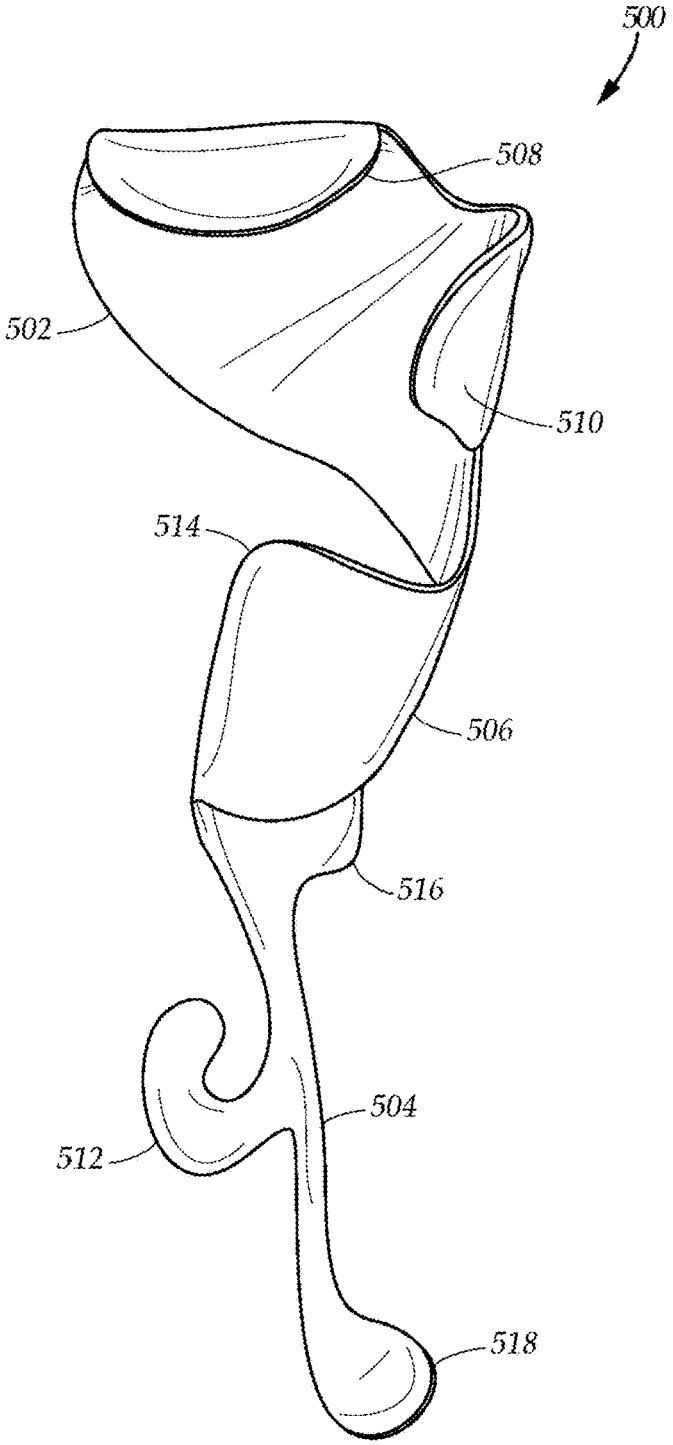
FIG. 7 shows a back view of an example embodiment of a necktie accessory according to the present disclosure.

FIG. 7 shows a back view of an example embodiment of a necktie accessory according to the present disclosure. Some elements of this figure are described above. Thus, same and/or similar reference characters identify same and/or like components described above and any repetitive detailed description thereof will hereinafter be omitted or simplified in order to avoid complication.

An accessory 500 can include any and/or all elements and/or functionality at least as described above. Accessory 500 includes a knot portion 502 and a helical portion 504. Knot portion 502 includes an L-tab portion 508 and a thumb portion 510, both of which abut portion 402 when accessory 500 is used with necktie 400.

Portion 508 and 510 can be identical to or different from each other. Knot 402 can be contained between L-tab 508 and thumb portion 510. L-tab 508 can include a protrusion extending therefrom such that L-tab 508 turns into a J-shape. Tab 510 can be L-shaped or J-shaped.

Accessory 500 includes a body 506 helically extending away from tab 508 such that body 506 helically extends at least once around portion 404 when accessory 500 is used with necktie 400. Body 506 includes a projection 512, a projection 514, a projection 516, and a projection 518 outwardly projecting therefrom, whether for enhancement of visual appearance and/or for applying force to portion 404 such that accessory 500 remains secured to necktie 400. Note that projection 518 extends from an end of body 506 distal to L-tab 508.

Figures 8A, 8B, 8C:
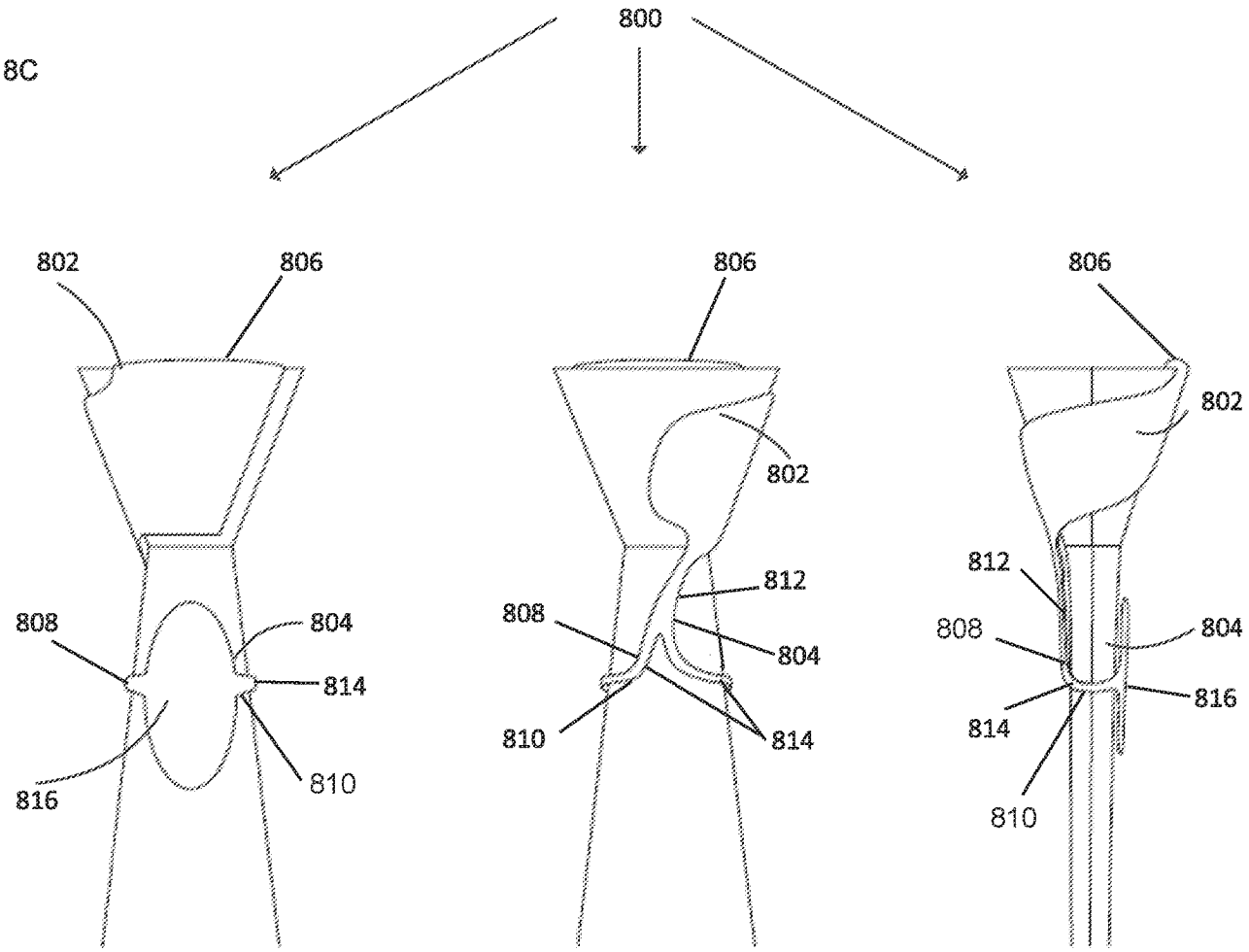
FIGS. 8A-8C show a plurality of views of an example embodiment of a necktie accessory accord to the present disclosure.

FIGS. 8A-C show a plurality of views of an example embodiment of a necktie accessory accord to the present disclosure. Some elements of this figure are described above. Thus, same and/or similar reference characters identify same and/or like components described above and any repetitive detailed description thereof will hereinafter be omitted or simplified in order to avoid complication.

FIGS. 8A-C contain a front view A, a rear review B, and a side view C of a necktie accessory 800, which contains a first portion 802 and a second portion 804. The necktie accessory 800 can be unitary or assembled, as disclosed herein. The first portion 802 is planar and can include a tab 806 extending over the knot of the necktie, as disclosed herein. The first portion 802 is rigid, but can be flexible. The first portion 802 is solid, but can be perforated. The first portion 802 can be unitary or assembled. The first portion 802 helically extends or positioned along or over the knot and the elongated portion along an axis, such as a central helix axis. The second portion 804 extends from the first portion 802. The second portion 804 comprises a loop portion 808 defining an opening 810. The second portion 804 can be unitary or assembled. The loop portion 808 comprises a root portion 812, a plurality of branch portions 814, and an island portion 816. The branch portions 814 extend from the island portion 816 and unite into the root portion 812, such as lasso style. The branch portions 814 extend over the elongated portion. The island portion 816 extends over the elongated portion. Therefore, the second portion 804 can be positioned such that the elongated portion extends through the opening 810.

In some embodiments, according the front view A, the first portion 802 helically wraps from a top of the knot, around a back of the knot, as per the rear view B, and wraps around two sides of the elongated portion, as per the side view C, to provide a surface area for designs and functions, such as the island portion 816. For example, the island portion 816 can depict, structure, contain, couple, attach, adhere, magnetically attract, or otherwise comprise/join any symbolic or alphanumeric design, which can be aesthetic, such as a jewelry item or a precious stone, or an output device, such as a speaker or a display or an antenna or a circuit or a semiconductor or any other electronic or mechanical device, or an input device, such as a camera, a microphone, a touchscreen, a button, a photovoltaic cell, an antenna, or any electronic or mechanical device, or a container, which can be selectively opened and closed via a door, whether pivoted or sliding, such as for containing a medicine or any other health or non-health related item, such as keys, batteries, earphones, or others. According to the rear view B, the second portion 804 splits below the knot, while wrapping around from a back of the elongated portion to a front of the elongated portion, as per the front view A. According to the side view C, such as a left side view, the necktie accessory 800 wraps around the sides of necktie. Therefore, the elongated portion of the tie is inserted through the opening 810, while granting a surface area, such as the island portion 816, being exposed, as per the front view A.

Figures 9A, 9B, 9C:
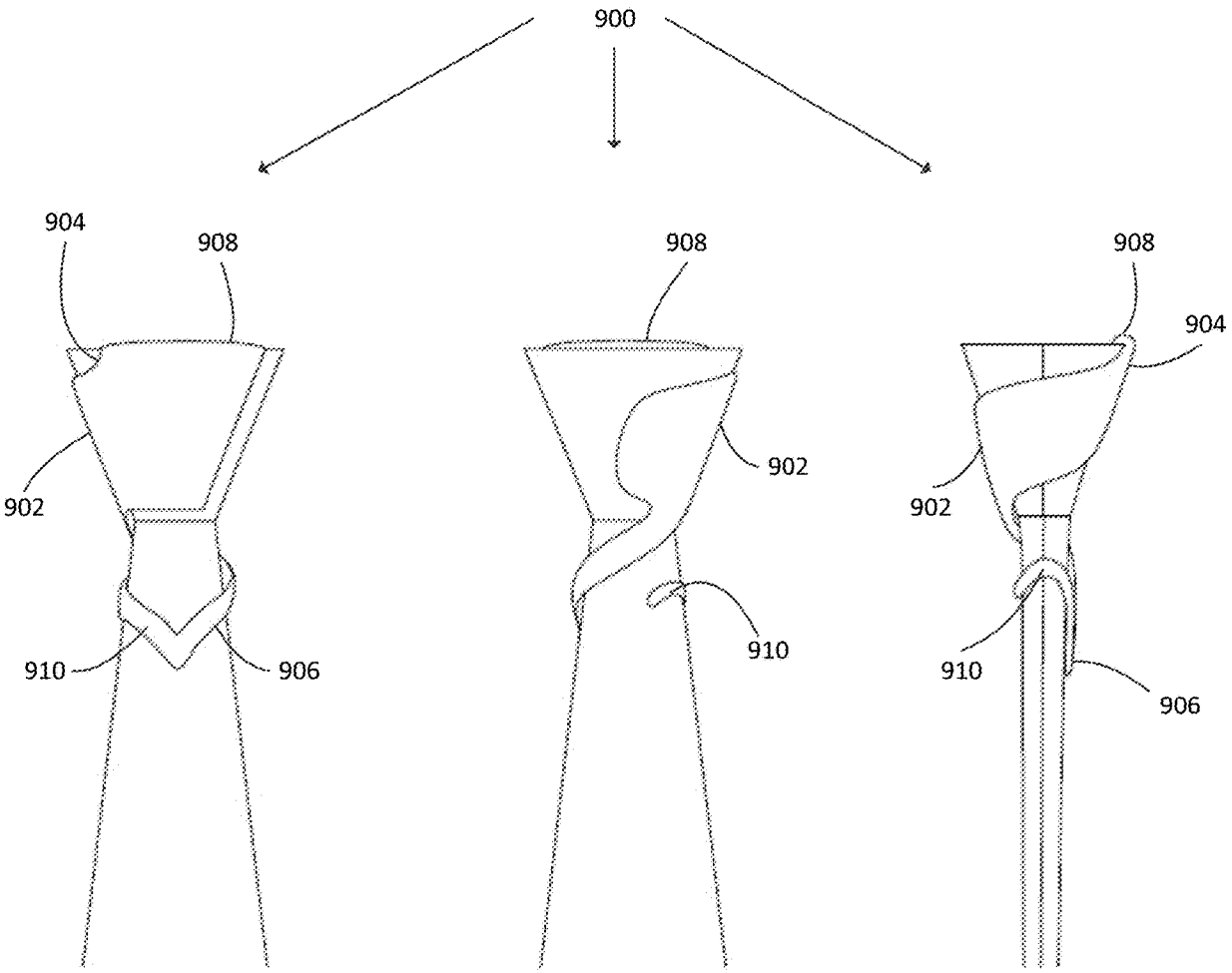
FIGS. 9A-9C show a plurality of views of an example embodiment of a necktie accessory accord to the present disclosure.

FIGS. 9A-C show a plurality of views of an example embodiment of a necktie accessory accord to the present disclosure. Some elements of this figure are described above. Thus, same and/or similar reference characters identify same and/or like components described above and any repetitive detailed description thereof will hereinafter be omitted or simplified in order to avoid complication.

FIGS. 9A-C contain a front view A, a rear review B, and a side view C of a necktie accessory 900, which contains a planar body 902. The necktie accessory 900 can be unitary or assembled, as disclosed herein. The planar body 902 is rigid, but can be flexible. The planar body 902 is solid, but can be perforated. The planar body 902 can be unitary or assembled. The planar body 902 helically extends about an axis or positioned along or over the knot and the elongated portion. For example, the planar body 902 can be extended helically about the axis, such as a central helix axis, such that the planar body 902 extends over the knot of the necktie and such that the planar body 902 extends over the elongated portion of the necktie. The planar body 902 comprises a first end portion 904 and a second end portion 906. The first end portion 904 extends from a planar tab 908 extending over the knot, as disclosed herein. The planar tab 908 can be unitary or assembled.

The necktie accessory 900 also includes a planar tail 910 extending from the second end portion 906 over the elongated portion toward the knot along the axis, such as in a V-manner, a U-Manner, a W-manner, an L-manner, a C-manner, or any other manner, whether acute, perpendicular, or obtuse, whether rectilinear, arcuate, sinusoidal, pulsating, or any other manner. The planar tail 910 can be unitary or assembled.

In some embodiments, as per the front view A, the planar body 902 helically wraps from the top of the knot; around the back of the elongated portion, as per the rear view B, and wraps once more around the side shown in the side view C, such as via the planar tail 910. As per the rear view B, the planar body 902 helically extends around the knot and the elongated portion and then once more around the side shown in the side view C acting like a thumb portion to hold the elongated portion in place. According to the side view C, the planar tab 908 extends from the top of the knot and the planar body 902 around the knot and then around the elongated portion. The tail portion 910 wrappingly enables a thumb portion to hold the elongated portion in position. The thumb portion is shown in the rear view on the lower right.

In some embodiments, any of the necktie accessories disclosed herein, such as the necktie accessory 300, 500, 800, 900, or others, can include a portion shaped in such a way such that the necktie can be selectively guided or inter-woven therethrough, such as in a hair comb style, such as in an S-manner, a J-manner, a Z-manner, an N-manner, or a C-manner. For example, such portion can be E-shaped, U-shaped, V-shaped, D-shaped, 8-shaped, 9-shaped, hair comb shaped, grid-shaped, or segment-shaped, such as any alphanumerical digit displayed in a seven-segment display, a fourteen-segment display, a sixteen-segment display, or any other shape that allows for selective guidance or interweaving of the necktie therethrough.

Figure 10A:
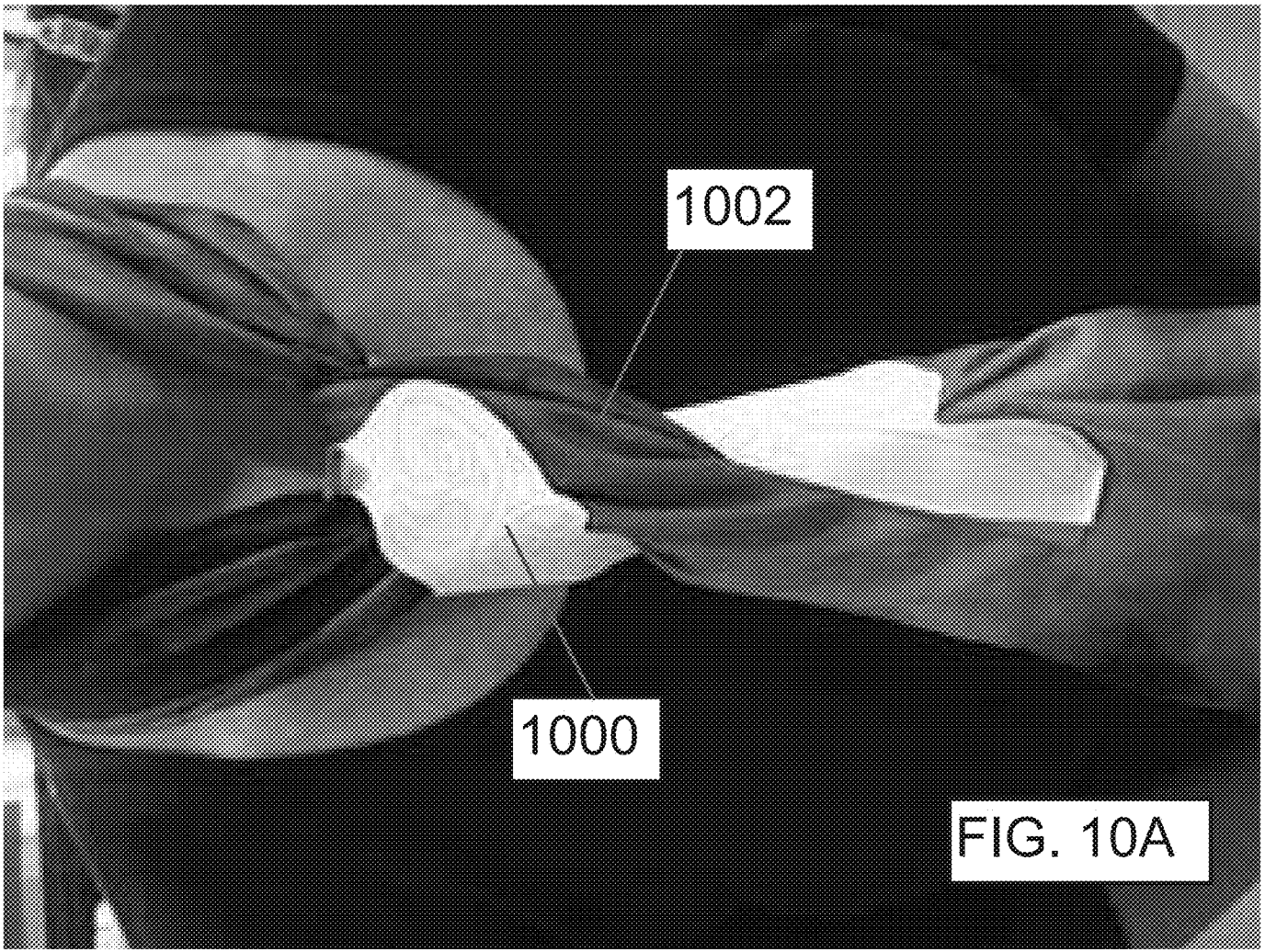
FIGS. 10A-10B show an embodiment of a garment accessory being worn on a garment according to this disclosure.
Figure 10B:
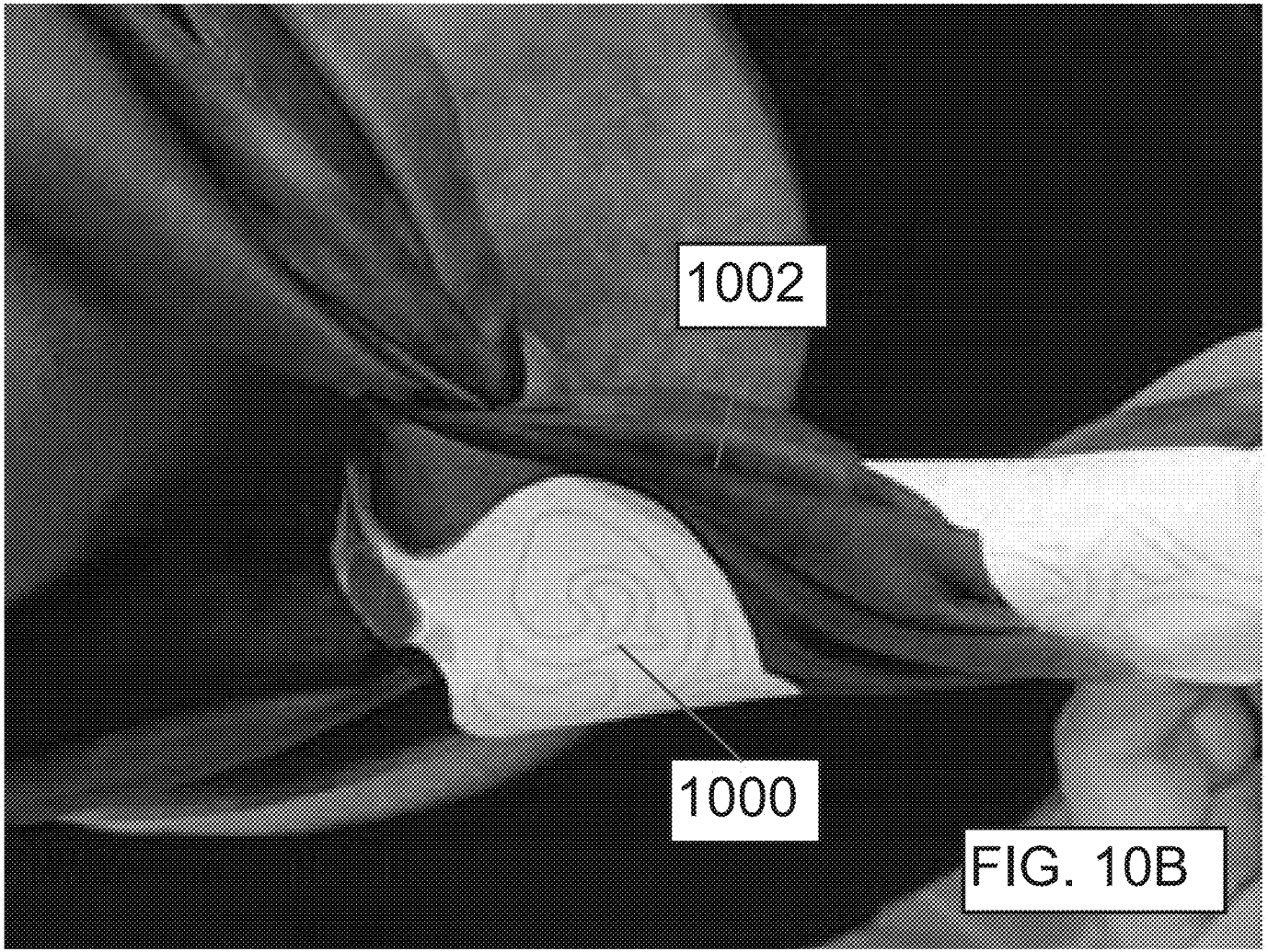
Figure 11A:
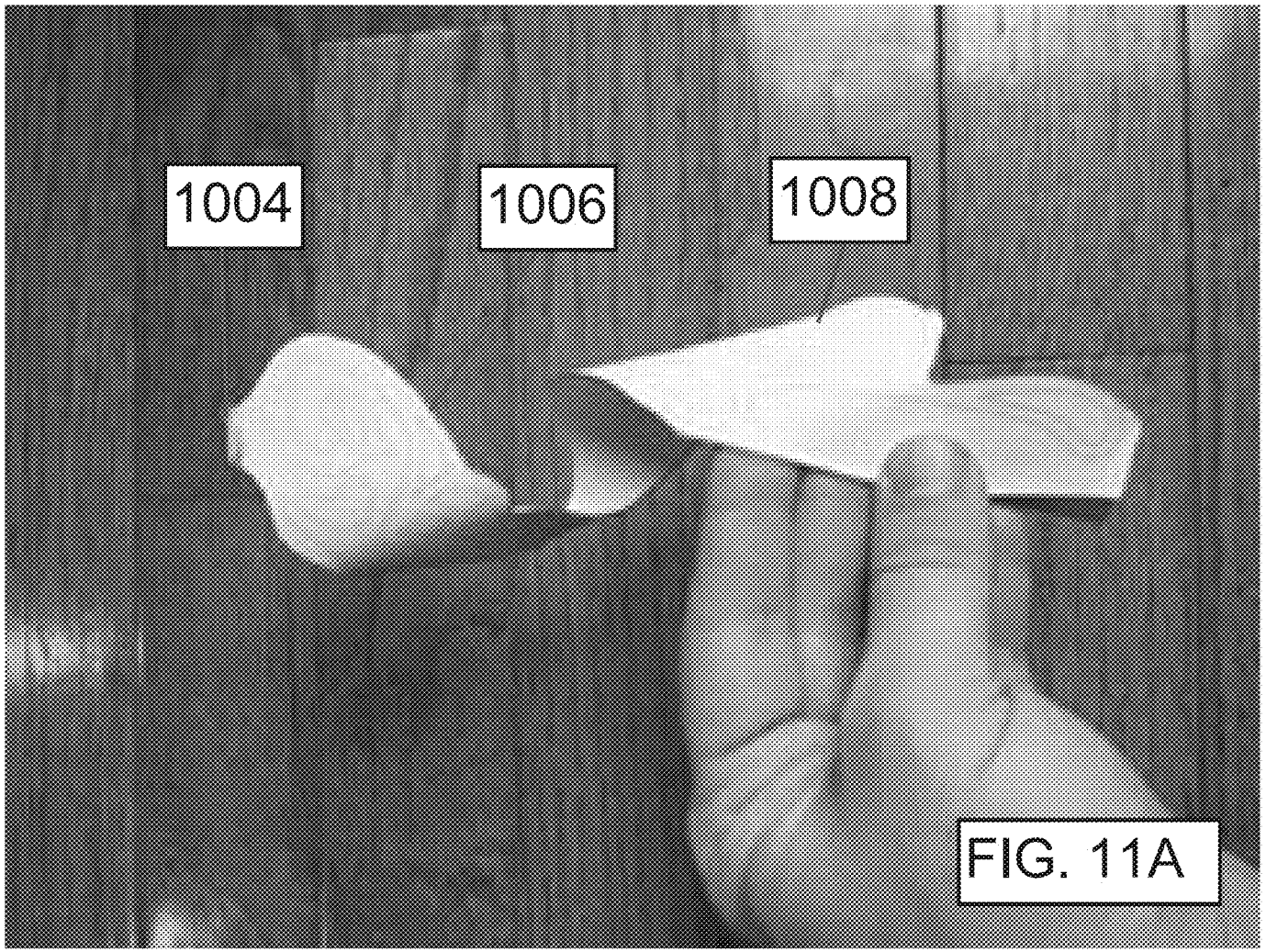
FIGS. 11A-11D show an embodiment of a garment accessory according to this disclosure.
Figure 11B:
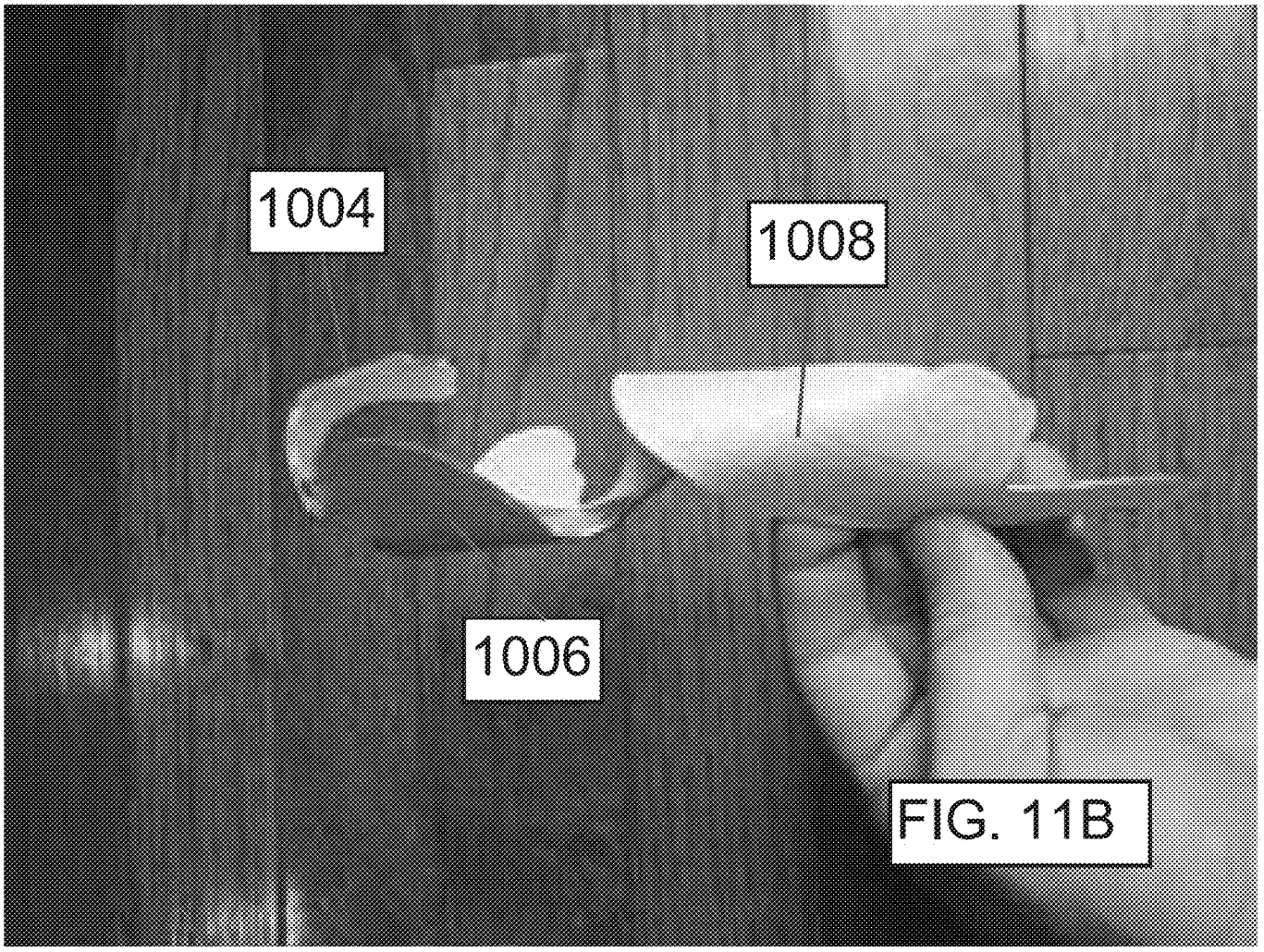
Figure 11C:
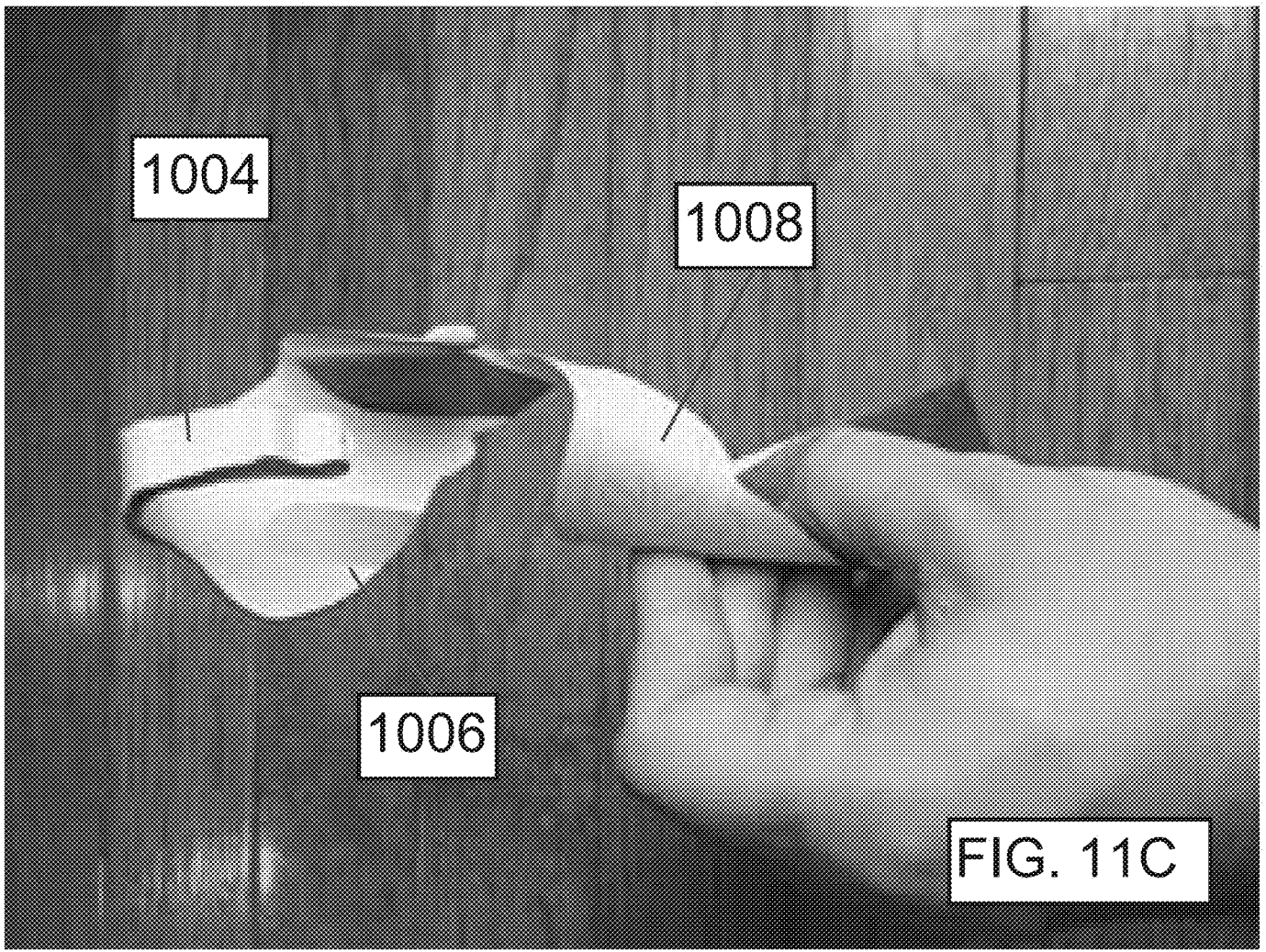
Figure 11D:
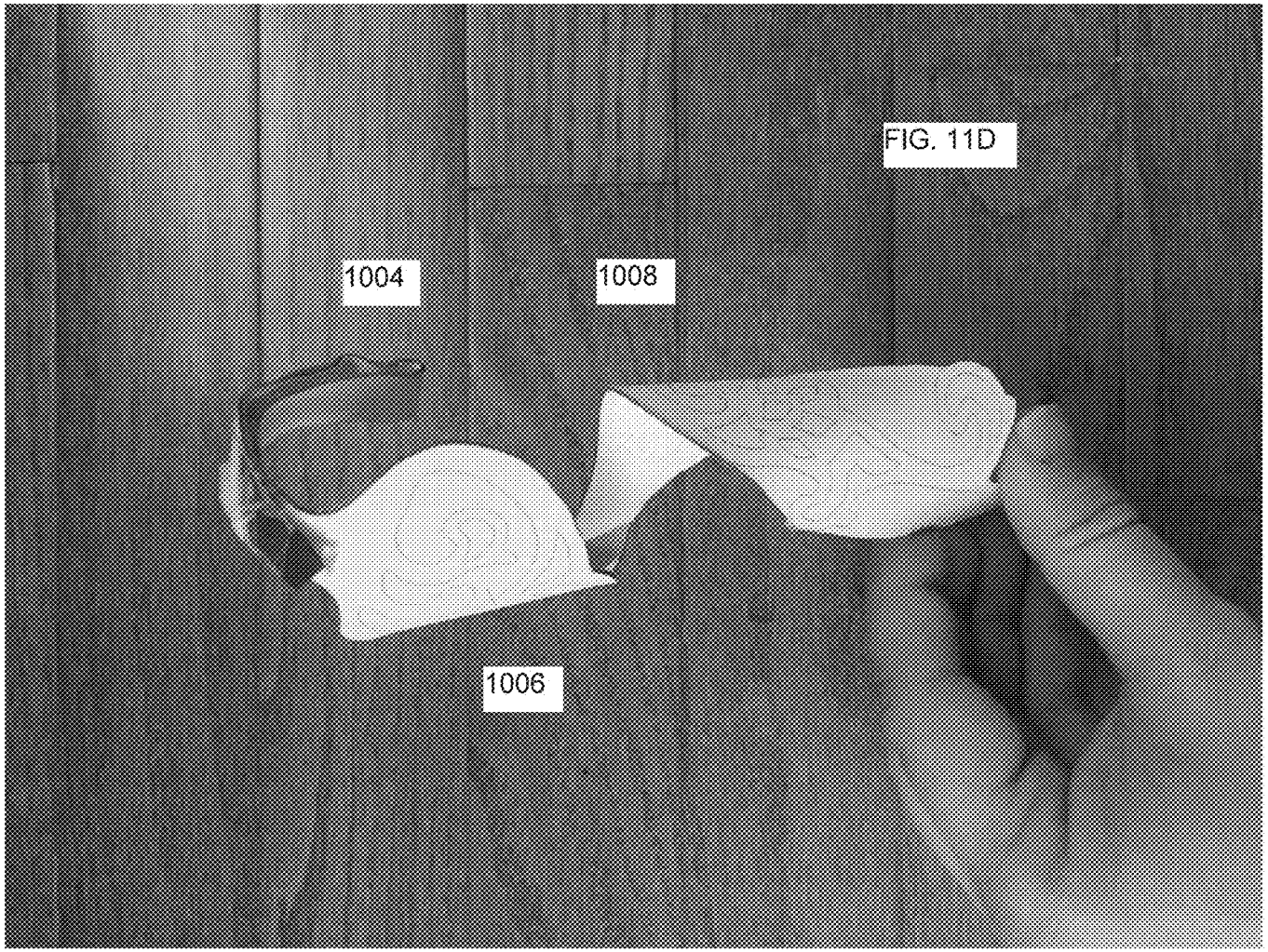

FIGS. 10A-10B show an embodiment of a garment accessory being worn on a garment according to this disclosure. FIGS. 11A-11D show an embodiment of a garment accessory according to this disclosure. In particular, a garment accessory 1000 is worn on a garment 1002, such as a tie, a scarf, a pashmina, a shawl, a cloth or leather headband, a cloth or leather belt, or others. Structurally, the garment accessory 1000 includes a tab portion 1004, a knot portion 1006 extending from the tab portion 1004, and a helical portion 1008 extending from knot portion 1006, as disclosed herein. However, the tab portion 1004 is extended further than others disclosed herein in order to structurally account for the garment 1002.

Figure 12A:
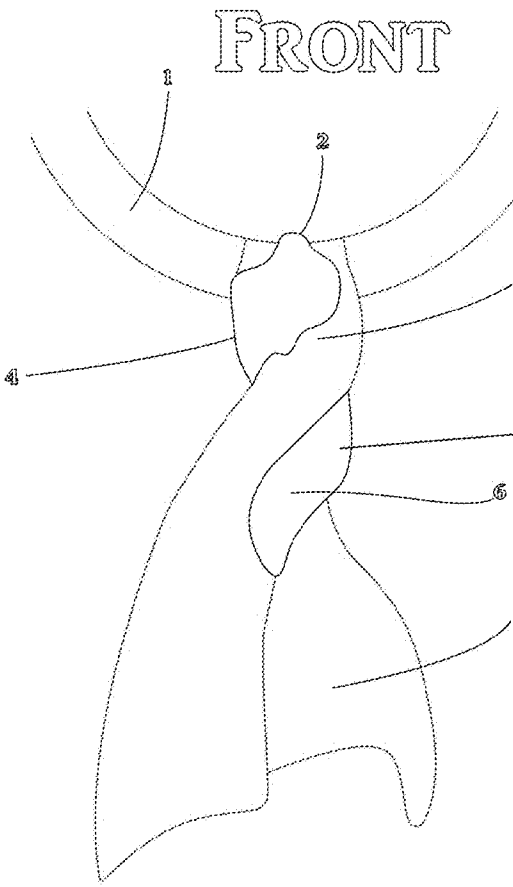
FIGS. 12A-12B show a diagram of an embodiment of a garment accessory being worn on a garment according to this disclosure.
Figure 12B:
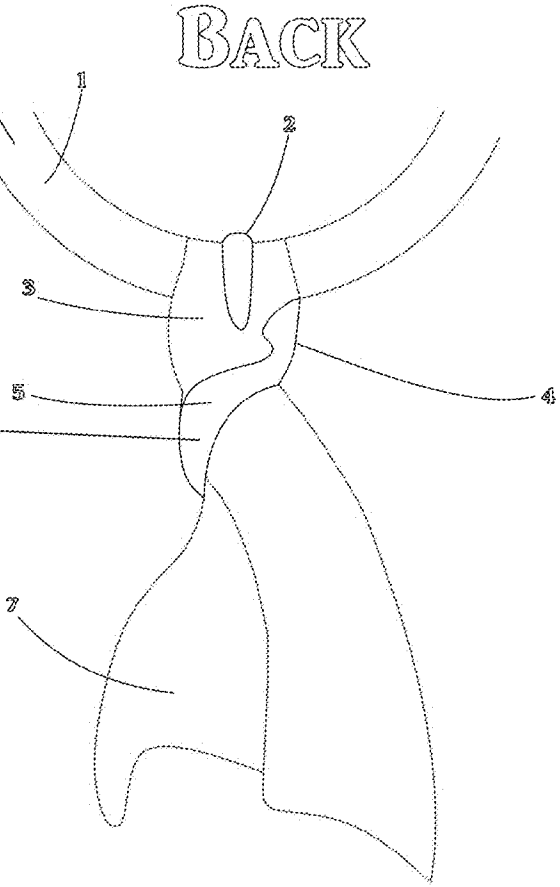

FIGS. 12A-12B show a diagram of an embodiment of a garment accessory being worn on a garment according to this disclosure. In particular, as shown herein, the garment 1002 includes a loop 1, a knot 3 extending from the loop 1, and a plurality of elongated material portions 7 extending from the knot 3. The garment accessory 1000 includes a tab portion 2 (1004 as described above), a knot portion 4 (1006 as described above), and a front helical portion 6 and a back helical portion 5 (collectively 1008 as described above).

The garment accessory 1000 is useful in various use cases. For example, the garment 1002 can include a tie, a scarf, a pashmina, a shawl, a cloth or leather headband, a cloth or leather belt, or others, including any piece of elongated material worn around a wearer's neck, shoulder, or body. For example, if the garment 1002, such as a scarf, a pashmina, a shawl, or others, is either tied or looped around the wearer' neck, shoulder, or body via the loop 1 such that there is the knot 3 is formed with elongated material portions 7 extending from the knot 3, then the wearer of the garment 1002 wants to hold the knot 3 in place and keep the knot 3 from loosening. For example, if the garment 1002, such as a cloth headband, a belt, or others, are either tied or looped around the wearer's head or waist such that the knot 3 is formed with elongated material portions 7 extending from the knot 3, then the wearer wearing the garment 1002 wants to hold the knot 3 in place and keep the knot 3 from loosening. Additionally, the wearer wearing the garment 1002 may want to hold the elongated material portions 7 in place such that the elongated material portion 7 do not fall, blow, or flow in various directions, but remain held together.

The garment accessory 1000 has the tab 2 that is operative in securing the knot 3 or the loop 1 such that the knot 3 or the loop 1 remain tied and do not loosen as the wearer moves about. The tab 2 tucks behind the loop 1 or the knot 3, putting pressure such that the loop 1 or the knot 3 are held tightly together.

The garment accessory 1000 has an elongated helical body (the front helical portion 6 and the back helical portion 5) that secures the elongated material portions 7 extending from the loop 1 or the knot 3 such that the loop 1 or the knot 3 do not flow about and remain held together in position. The tab 2 of the garment accessory 1000 is visible holding the loop 1 or the knot 3, while the helical body is partially hidden as the helical body wraps around the elongated material portions 7 (lower elongated portion is visible).

The description of the present disclosure has been presented for purposes of illustration and description, but is not intended to be fully exhaustive and/or limited to the disclosure in the form disclosed. Many modifications and variations in techniques and structures will be apparent to those of ordinary skill in the art without departing from the scope and spirit of the disclosure as set forth in the claims that follow. Accordingly, such modifications and variations are contemplated as being a part of the present disclosure. The scope of the present disclosure is defined by the claims, which includes known equivalents and unforeseeable equivalents at the time of filing of the present disclosure.

What is claimed is:

1. A method comprising:

extending a tab over a top surface of a knot of a garment after the knot is fully formed, wherein the garment comprises an elongated portion extending from the knot; and extending a planar body helically about the elongated portion, wherein the planar body comprises a first end portion and a second end portion, wherein the tab extends from the first end portion, wherein the first end portion is between the tab and the second end portion.

2. The method of claim 1, wherein the tab is L-shaped.

3. The method of claim 1, wherein the tab is J-shaped.

4. The method of claim 1, wherein the tab includes an arcuate portion.

5. The method of claim 1, wherein the garment is a neck garment.

6. The method of claim 5, wherein the garment is a tie.

7. The method of claim 5, wherein the garment is a scarf.

8. The method of claim 1, wherein the tab is planar.

9. The method of claim 1, wherein the planar body and the tab are unitary.

10. The method of claim 1, wherein the planar body and the tab are assembled.

11. The method of claim 1, wherein the planar body comprises a photovoltaic cell.

12. The method of claim 1, wherein the planar body comprises a microphone.

13. The method of claim 1, wherein the planar body comprises a thumb portion stemming therefrom between the first end portion and the second end portion.

14. The method of claim 1, where the planar body comprises a projection extending therefrom between the first end portion and the second end portion, wherein the projection extends in a direction towards the knot or away from the knot.

15. A method comprising:

positioning a first portion over a top surface of a knot of a garment, wherein the garment comprises an elongated portion extending from the knot, wherein the first portion extends from a second portion comprising a loop portion defining an opening, wherein the loop portion comprises a root portion, a plurality of branch portions, and an island portion, wherein the branch portions extend from the island portion and vertically unite into the root portion below the knot, wherein the branch portions extend over the elongated portion, wherein the island portion extends over the elongated portion, wherein the knot is positioned between the first portion that extends over the top surface and the island; and positioning the second portion such that the elongated portion extends through the opening.

16. The method of claim 15, wherein the garment is a tie.

17. The method of claim 15, wherein the garment is at least one of a scarf, a pashmina, a shawl, a band, or a belt.

18. A method comprising:

extending a planar body helically about an axis such that the planar body extends over a knot of a garment after the knot is fully formed and such that the planar body extends over an elongated portion of the garment, wherein the elongated portion extends from the knot, wherein the planar body comprises a first end portion and a second end portion, wherein the knot includes a top surface, wherein the first end portion extends from a tab extending over the top surface of the knot; and extending a tail from the second end portion over the elongated portion toward the knot or away from the knot along the axis.

19. The method of claim 18, wherein the garment is a tie.

20. The method of claim 18, wherein the garment is at least one of a scarf, a pashmina, a shawl, a band, or a belt.

* * * * *